United States Patent [19]

O'Neal

[11] Patent Number: 4,756,358

[45] Date of Patent: Jul. 12, 1988

[54] DEFROST HEATER SUPPORT

[75] Inventor: Robert G. O'Neal, Yuma, Ariz.

[73] Assignee: Ardco, Inc., Brea, Calif.

[21] Appl. No.: 913,074

[22] Filed: Sep. 29, 1986

[51] Int. Cl.[4] ..... F25D 21/06; H05B 1/00

[52] U.S. Cl. ..... 165/1; 165/64; 62/80; 62/275; 62/276; 219/201; 219/530; 219/540

[58] Field of Search ..... 62/275, 276, 80; 219/200, 201, 530, 540, 536, 542; 165/1, 64

[56] References Cited

U.S. PATENT DOCUMENTS

| | | | |
|---|---|---|---|
| 2,001,323 | 5/1935 | Dick | 62/80 |
| 2,266,373 | 12/1941 | Marlo | 219/201 X |
| 2,963,882 | 12/1960 | Malkoff et al. | 62/276 |
| 3,063,253 | 11/1962 | Dickson et al. | 219/201 X |
| 3,099,914 | 8/1963 | DeWitt et al. | 219/201 X |
| 3,381,494 | 5/1968 | Steelman | 62/80 X |
| 3,394,559 | 7/1968 | Jones | 62/276 |
| 3,436,931 | 4/1969 | Gelband | 62/276 |
| 3,638,449 | 2/1972 | Lichtenberger | 62/80 X |
| 3,783,635 | 1/1974 | Perez | 165/64 |
| 4,152,900 | 5/1979 | Chopra et al. | 62/275 x |
| 4,369,350 | 1/1983 | Kobayashi et al. | 219/201 |
| 4,462,216 | 7/1984 | Kramer | 62/80 |
| 4,474,029 | 10/1984 | Kennon | 62/275 X |
| 4,492,851 | 1/1985 | Carr | 62/276 X |

FOREIGN PATENT DOCUMENTS

| | | | |
|---|---|---|---|
| 559502 | 7/1958 | Canada | 62/276 |

*Primary Examiner*—Albert W. Davis, Jr.
*Assistant Examiner*—John K. Ford
*Attorney, Agent, or Firm*—Knobbe, Martens, Olson & Bear

[57] ABSTRACT

An air cooler having coolant tubes, a drain, a pair of coolant tube supports and a defroster for preventing condensate in the drain from freezing. The coolant tube supports include a vertical plate provided with a pair of horizontally spaced notches for supporting the defroster. The notches open to the lower edge of the plate and converge towards one another.

5 Claims, 1 Drawing Sheet

Fig. 1
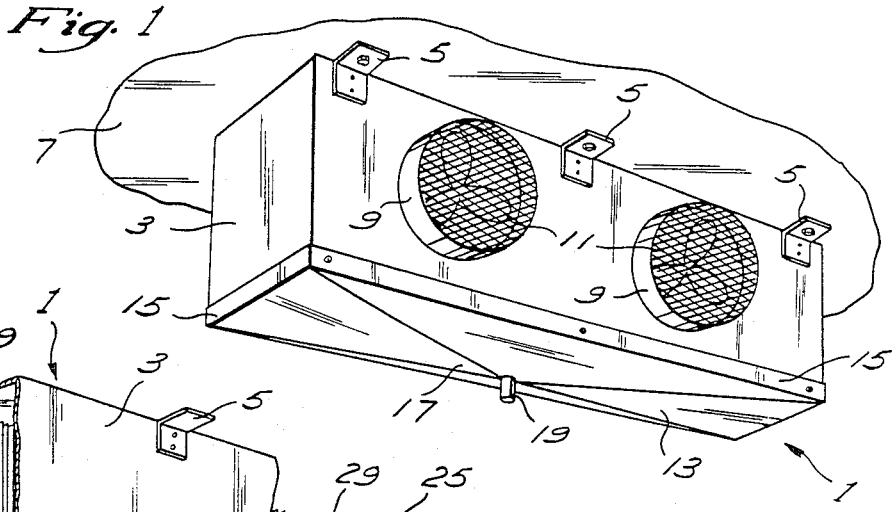
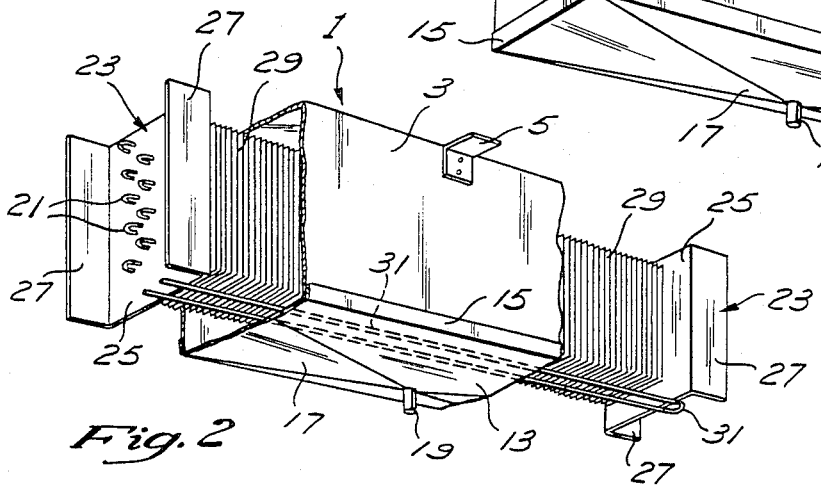
Fig. 2
Fig. 3
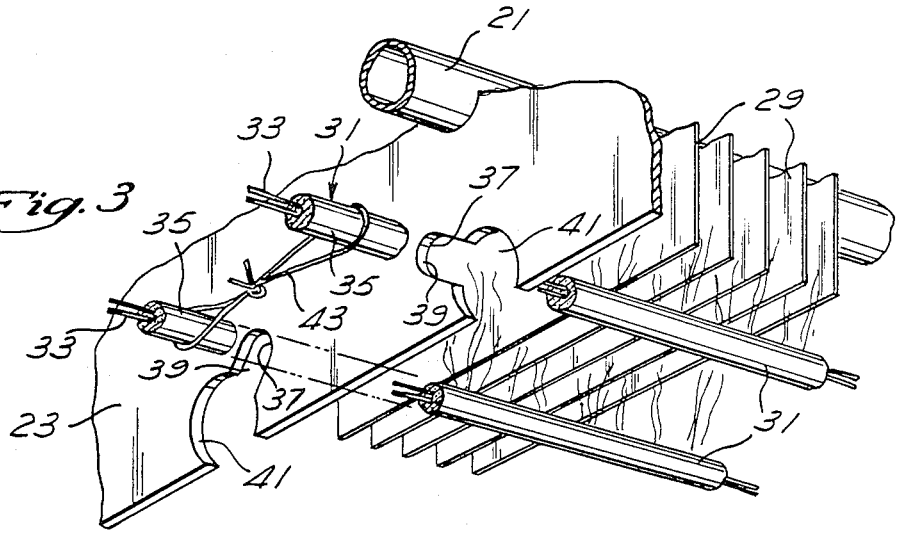
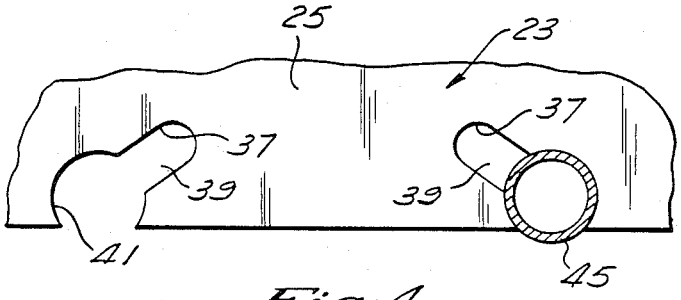
Fig. 4

DEFROST HEATER SUPPORT

BACKGROUND OF THE INVENTION

This invention relates to air coolers and, in particular, to low profile unit coolers utilizing refrigeration cooling.

Low profile unit coolers are designed to cool a variety of spaces such as walk-in coolers, beverage boxes, meat cutting and storage rooms, and produce storage areas. The coolers have been widely used due to their high output and compact size. Typically, the coolers are supported in the upper part of a room and have a short side profile so that floor space is not sacrificed.

The coolers incorporate an elongate, continuous coil which is secured at either end by a support member. The support member typically includes a vertical plate containing pairs of holes through which the tubes of the coil extend. The coils are formed by inserting the open ends of U-shaped tubes through the pairs of holes in the vertical plates and by connecting these open ends to one another with short U-shaped lengths of tubing.

A number of thin rectangular heat exchange fins containing holes which correspond to those of the end support members are generally fitted over the lengths of tubing before the tubes are connected. The fins are equally spaced along the tubes in order to facilitate the exchange of heat between the coils and the surrounding air. Although the spacing of the fins varies depending on the expected use of the cooler, the fins typically are spaced between $\frac{1}{4}''$ and $\frac{1}{8}''$ apart.

The units are enclosed by elongate, box-shaped, rust-proof outer housings and include one or more electrical fans which circulate the cooled air.

When a unit is operating, condensation has a tendency to form on the heat exchange fins and the refrigeration coil. If ice forms on the coil and fins, defroster heat is provided periodically, causing the frozen condensate to melt. A drainage pan secured to the base of the cooler housing catches this condensate as it drips from the fins and the coil. To prevent the condensate from freezing and plugging the pan's drain, the coolers are provided with either electric or gas drainage pan defrosters.

The electric defrosters are usually simple U-shaped resistance heaters which are connected by wires to the electrical circuit box of the cooler unit. These resistance heaters are typically secured to the drainage pan by means of brackets. Unfortunately, the use of brackets adds to the overall cost of the unit both in terms of materials and labor. The materials costs increase due to the cost of the brackets themselves and the labor costs increase due to the time required to secure the brackets to the drainage pan.

The brackets also pose a potential sanitation problem. One possibility is that the brackets themselves will contaminate the unit. Additionally, because the brackets have a tendency to trap sediment and make it difficult to properly clean the drainage pan, the brackets may accentuate the possibility of contamination due to other causes.

The use of brackets also leads to other maintenance problems. Specifically, the most convenient means of repairing or maintaining the internal components of the cooler is to remove the drainage pan. Unfortunately, the drainage pan can not be completely removed from the cooler because the electrical connections between the control box and the resistance heater are too short. As a result, maintenance and repair work on the internal components of the cooler is less convenient and more time consuming.

One method of avoiding some of the drawbacks inherent in bracketing a resistance heater to a cooler's drainage pan is to suspend the resistance heater from the refrigerator coil by wires. This involves the relatively difficult task of wrapping one end of the wires between the narrowly spaced heat exchange fins and around the tubes of the refrigeration coil, and wrapping the other end of the wires around the resistance heater. This procedure has proved unsatisfactory due to the time and effort required to perform it.

Cooler units can also be provided with gas heat defrosters, rather than electric defrosters. The gas defrosters are typically U-shaped tubes containing hot gas. Commonly, brackets are used to suspend the gas filled tubes from the cooler's end support units.

As with the case of the electrical defroster, the use of brackets to secure the defroster adds to the overall cost of the cooler both in terms of materials and labor.

Thus, there is a need for a new and improved cooler in which cooler drainage pan defrosters can be more easily and efficiently secured.

SUMMARY OF THE INVENTION

The invention comprises an air cooler including coolant tubes mounted on supports having notches for supporting a defroster for preventing condensate in an adjacent drain from freezing. Thus, the defroster is easily installed and supported by the coolant tube supports rather than the drain pan.

Advantageously, the supports are also provided with a larger pocket near the mouth of each of the notches for receiving and retaining gas defrosters, and the inner notch is sized to receive an electric defroster. With these mounting approaches, the drainage pan can be conveniently moved and cleaned without interference from the defrosters.

DESCRIPTION OF THE DRAWINGS

These and other features of the invention will now be described with reference to drawings of the preferred embodiment which is intended to illustrate, and not to limit, the invention, and in which:

FIG. 1 is a perspective view of a cooler embodying the present invention;

FIG. 2 is a partially cut-away perspective view of the cooler of FIG. 1;

FIG. 3 is an enlarged, partial perspective view illustrating the electric defroster and upwardly converging notches of the cooler of FIG. 1; and FIG. 4 is an enlarged partial sectional view of the upwardly converging notches of the cooler of FIG. 1 shown supporting a gas defroster.

DESCRIPTION OF THE PREFERRED EMBODIMENT

Referring to FIG. 1, there is shown a low profile unit cooler 1 having an elongate, box-shaped, rust-proof outer housing 3 which includes a top, a front wall and two side walls. The rear of the housing is open to provide an air inlet for the cooler. A series of brackets 5 are used to mount the housing 3 to a mounting surface 7. Two generally cylindrical, screened fan ducts 9 house a pair of fans 11 which circulate air through the cooler.

A generally rectangular drainage pan 13 is removably secured to the bottom of the housing 3. Advantageously, the drainage pan has four short sidewalls 15 and a downwardly inwardly sloping bottom panel 17. Located at the lowest point of the drainage pan 13 is a cylindrical opening or drain 19.

Referring now to FIG. 2, a series of coolant tubes 21 within the housing 3 are supported by a pair of coolant tube supports 23. The tubes 21 are interconnected to form a continuous coil. The coolant tube supports 23 include a vertical plate 25 containing pairs of holes through which the coolant tubes extend and two vertical outer flanges 27. Numerous thin, vertical, rectangular heat exchange fins 29, containing holes corresponding to those of the coolant tube supports 23, are equally spaced along the coolant tubes between the two supports 23.

Referring still to FIG. 2, an elongate, generally U-shaped electrical resistance heater or defroster 31 is secured to each of the supports 23 proximate the drainage pan 13. As best seen in FIG. 3, the defroster 31 consists of an electrically conductive resistance heating core 33 encased within a stainless steel tube 35 which is electrically insulated from the core 33 by a layer of asbestos powder. When electricity flows through the defroster core 33 the defroster 31 heats the drainage pan 13, thereby preventing the condensate therein from freezing and plugging the drain 19.

The defroster 31 is supported at each end within a pair of horizontally spaced notches 37 formed in the lower portion of each of the support plates 25. As best seen in FIG. 4, the notches 37 converge upwardly at an angle about 45° from the horizontal. The notches include an internal channel 39 opening to an outer pocket 41. The internal channels 39 have parallel sides and a semi-circular end. Advantageously, the notches 37 are positioned so that the distance between the ends of their respective internal channels 39 is equivalent to the distance between the open ends of the U-shaped defroster 31. At the mouth of each internal channel 39 is a larger outer pocket 41 which forms a ¾ circle and which has an entrance at the lower edge of the plates 25 of the supports 23.

The defroster 31 can be easily secured to the supports 23 by bending its open ends outward so that each leg fits through the mouth of the outer pockets 41 and can be slid into the internal channels 39 of the notches 37. As shown in FIG. 3, the defroster is advantageously provided with means for connecting the open ends of the defroster, such as a wire 43, to securely retain the legs of the defroster 31 within the notches so that the defroster is supported by the supports 23.

Referring now to FIG. 4, the pockets 41 are adapted to receive and secure a gas defroster 45. The entry edges of the outer pocket 41 can be bent away from the mouth with pliers to permit the entry of the defroster 45 into the outer pocket 41. The pliers can then be used again to bend the edges of the outer pocket back to their original position, thereby securely retaining the gas defroster 45 in close proximity to the drainage pan.

Thus, there is provided a cooler in which drainage pan defrosters can be more efficiently secured and supported. The present invention provides for the quick and easy installation of either gas or electric defrosters without interference to the drainage pan, while yet providing effective defrosting.

I claim:

1. An air cooler, comprising:

coolant tubes;

a drain;

a defroster for preventing condensate in said drain from freezing;

a pair of coolant tube supports, including a vertical plate through which said coolant tubes extend, said vertical plate including a pair of horizontally spaced notches for receiving and supporting said defroster, said notches opening to the lower edge of said plate formed so the sides of the portion of said plate between said pair of notches converge toward one another from said lower edge.

2. The cooler of claim 1, wherein said defroster has open ends, additionally comprising means for connecting said open ends of said defroster so that said defroster is retained within said notches and is supported by said supports.

3. The cooler of claim 2, wherein said notches include a larger pocket opening to the lower edge of said plate for receiving and securing a defroster.

4. The cooler of claim 1, including a housing enclosing said tube supports and tubes, a drain pan forming the bottom wall of said housing with said drain formed therein, said pan being positioned in close proximity to the lower edge of said vertical plate.

5. A method of suspending a drain pan defroster having two open ends from a cooler's coolant tube supports, comprising the steps of:

inserting said open ends of said defroster through notches in one of said supports;

positioning said open ends of said defroster to align said defroster within the openings of a pair of converging notches in a second of said supports;

moving the open ends of said defroster closer to one another causing said defroster to be received by said converging notches and to be supported by said supports; and securing said defroster to said supports by connecting said open ends.

* * * * *